US009431773B2

(12) United States Patent
Chen et al.

(10) Patent No.: US 9,431,773 B2
(45) Date of Patent: Aug. 30, 2016

(54) PROBE-TYPE CONNECTOR

(71) Applicant: BELLWETHER ELECTRONIC CORP., Taoyuan County (TW)

(72) Inventors: Kuan-Wu Chen, Taoyuan County (TW); Chia-Hung Kuo, Taoyuan County (TW); Hsing-Yu Lee, Taoyuan County (TW)

(73) Assignee: BELLWETHER ELECTRONIC CORP., Taoyuan County (TW)

( * ) Notice: Subject to any disclaimer, the term of this patent is extended or adjusted under 35 U.S.C. 154(b) by 0 days.

(21) Appl. No.: 14/935,703

(22) Filed: Nov. 9, 2015

(65) Prior Publication Data

US 2016/0197444 A1 Jul. 7, 2016

(30) Foreign Application Priority Data

Jan. 6, 2015 (TW) ..... 104100343 A

(51) Int. Cl.

| | |
|---|---|
| ***H01R 13/24*** | (2006.01) |
| ***H01R 13/66*** | (2006.01) |
| *H01R 12/72* | (2011.01) |
| *H01R 12/58* | (2011.01) |
| *H01R 12/70* | (2011.01) |
| *H01R 13/514* | (2006.01) |

(52) U.S. Cl.

CPC ..... *H01R 13/665* (2013.01); *H01R 13/2421* (2013.01); *H01R 12/58* (2013.01); *H01R 12/7005* (2013.01); *H01R 12/721* (2013.01); *H01R 13/514* (2013.01)

(58) Field of Classification Search

CPC ..... H01R 13/2421; H01R 12/721; H01R 12/7005; H01R 12/58; H01R 12/7029; H01R 13/514

USPC ..... 439/260, 637, 620.22, 482, 700, 634, 439/635

See application file for complete search history.

(56) References Cited

U.S. PATENT DOCUMENTS 4,189,203 A * 2/1980 Miller ..... G01B 7/13 439/263

9,350,104 B1 * 5/2016 Chen ..... H01R 12/716

* cited by examiner

*Primary Examiner* — Abdullah Riyami
*Assistant Examiner* — Justin Kratt
(74) *Attorney, Agent, or Firm* — Chun-Ming Shih; HDLS IPR Services

(57) ABSTRACT

A probe-type connector includes an insulating body having a receiving space and a plugging slot which both communicate with each other, a probe set received in the receiving space and including a probe terminal, an insulating part, and an elastic part, and a connecting plate plugged into the insulating body corresponding to the plugging slot and having a connecting portion. The probe terminal has a connecting segment, and a flexible connecting arm extending from the connecting segment toward the plugging slot. The insulating part is connected between the connecting segment and the elastic part that enables the insulating part and the probe terminal to reciprocate in the receiving space. The flexible connecting arm is electrically connected to the connecting portion. Therefore, the probe terminal can transmit electrical signals directly to the connecting plate, which can be applied to the transmission of high-frequency signals or electrical energy.

10 Claims, 7 Drawing Sheets

PROBE-TYPE CONNECTOR

BACKGROUND OF THE INVENTION

1. Field of the Invention

The present invention relates to an electrical connector, in particular, to a probe-type connector which is applicable to transmit high-frequency signals.

2. Description of Related Art

The probe-type connector is usually disposed in an installation space of an electronic device such as the installation spaces of batteries, a power supply unit, and electronic components. The probe-type connector is mainly electrically connected to the batteries or the power supply unit to provide electrical energy for the electronic device or is electrically connected to the electronic components to transmit signals to the electronic device.

The existing probe-type connector mainly comprises an insulating part, plural probes, and plural connecting terminals. The probe is movably disposed in the insulating part and comprises a retractable terminal and an elastic component. The elastic component is supported between the retractable terminal and the insulating part such that the retractable terminal can reciprocate in the insulating part. One end of the connecting terminal is movably and electrically connected to the probe. The other end of the connecting terminal is welded to a printed circuit board (PCB) disposed vertically or is welded to a cable by means of a PCB disposed horizontally. When the above-mentioned batteries, power supply unit, or electronic components are connected to the probe-type connector, the retractable terminals will undergo forces and be compressed to keep in a conducting state using the connecting terminals such that the electrical signals can be transmitted to the PCB through the retractable terminals and the connecting terminals, or even to the cable through the PCB.

However, the existing probe-type connector has the follow disadvantages. Because the probe is located on the transmission path of the retractable terminal and the connecting terminal, the transmission path includes more components and becomes longer. Also, the transmission between the retractable terminal and the connecting terminal is the contact transmission, which is likely to cause the problem of signal decay during the transmission. Thus, such transmission is not applicable to the transmission of high-frequency signals and is even difficult to be used in the transmission of high-frequency signals.

In view of this, how to design an invention to overcome the above disadvantages becomes an important topic the inventor desires to deal with.

SUMMARY OF THE INVENTION

It is an objective of the present invention to provide a probe-type connector which can reduce the number of conducting components through which the electric signal is transmitted such that the probe can transmit the electrical signals directly to the connecting plate like a PCB to prevent the signal attenuation and further can be applied to the transmission of high-frequency signals or high-frequency electrical energy to obtain a good transmission effect.

It is another objective of the present invention to provide a probe-type connector in which the connecting plate can be directly contacted with the probe, which therefore can omit the traditional connecting terminals and can solve the problem of the traditional connecting terminals having to be installed one by one. Thus, an effect of easy assembly is obtained.

In order to achieve the above objectives, the present invention provides a probe-type connector comprising an insulating body, a probe set, and a connecting plate. The insulating body is provided with a receiving space and a plugging slot which both communicate with each other. The probe set is received in the receiving space and comprises a probe terminal, an insulating part, and an elastic part. The probe terminal has a connecting segment and a flexible connecting arm extending from the connecting segment toward the plugging slot. The insulating part is connected between the connecting segment and the elastic part. The elastic part enables the insulating part and the probe terminal to reciprocate in the receiving space. The connecting plate is provided with a connecting portion. The connecting plate is plugged and connected to the insulating body corresponding to the plugging slot. The flexible connecting arm of the probe terminal is electrically connected to the connecting portion.

Compared with the prior art, the present invention has the following effects. By means of the flexible connecting arm extending from the probe terminal, the electrical signals can be transmitted directly to the connecting plate, which prevents the excessive connecting components on the transmission path and the signal attenuation caused by undue transmission path. Thus, the present invention can be applied to the transmission of high-frequency signals or high-frequency electrical energy and can obtain a good transmission effect.

DETAILED DESCRIPTION OF THE INVENTION

Figure 1:
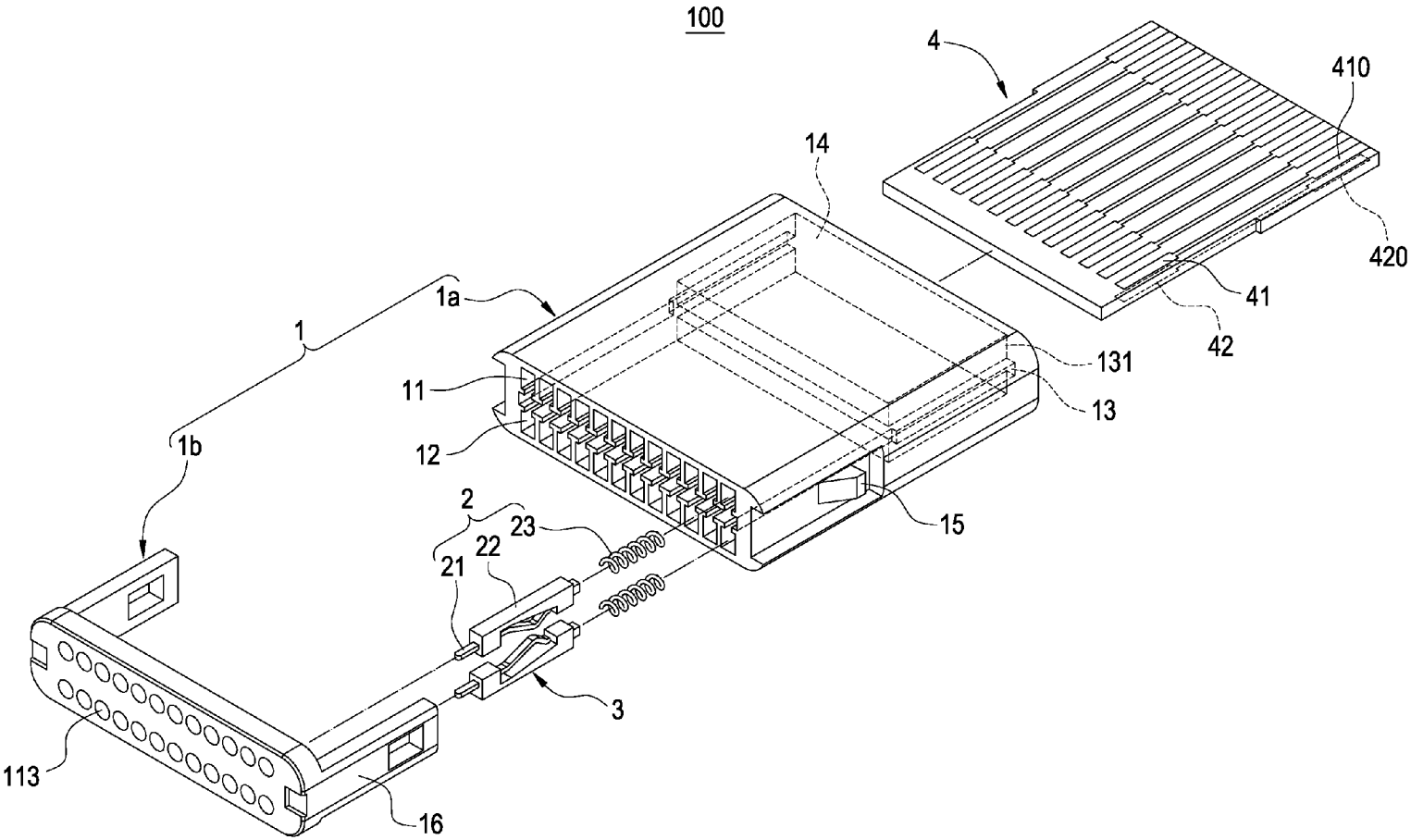
FIG. 1 is a perspective exploded view of the probe-type connector of the present invention (the metal shell not shown)

The detailed description and technical details of the present invention will be explained below with reference to accompanying figures. However, the accompanying figures are only for reference and explanation, but not to limit the scope of the present invention.

The present invention provides a probe-type connector, as shown in the accompanying figures, which is disposed in an installation space (not shown) of an electronic device (not shown) such as the installation spaces of batteries, a power supply unit, and electric components. When a connected product 800 like a battery, a power supply unit, or an electronic component (shown in FIG. 6) is installed in the installation space and is then connected against the connector 100 of the present invention, the electrical energy or signals of the connected product 800 can be transmitted to the electronic device.

As shown in FIGS. 1-5, the connector 100 of the present invention comprises an insulating body 1, at least one first probe set 2, and a connecting plate 4. Preferably, the connector 100 further comprises a metal shell 5. In the current embodiment, the connector 100 further comprising at least one second probe set 3 is used as an example for explanation.

As shown in FIG.1, the insulating body 1 can be an integrated structure or can comprise a first insulator 1*a* and a second insulator 1*b* connected to the front end surface of the first insulator 1*a* which both are combinable to each other. Further, the insulating body 1 can be provided with a first receiving space 11 and a plugging slot 13 which both communicate with each other (refer to FIG. 5) or can be provided with plural first receiving spaces 11 and a plugging slot 13 which communicate with one another. In the current embodiment, the insulating body 1 with plural first receiving spaces 11, plural second receiving spaces 12, and a plugging slot 13 which communicate with one another is used as an example for explanation, but not limited to this case. Of course, the above-mentioned first probe set 2 and the second probe set 2 should be disposed in plurality accordingly.

Figure 5:
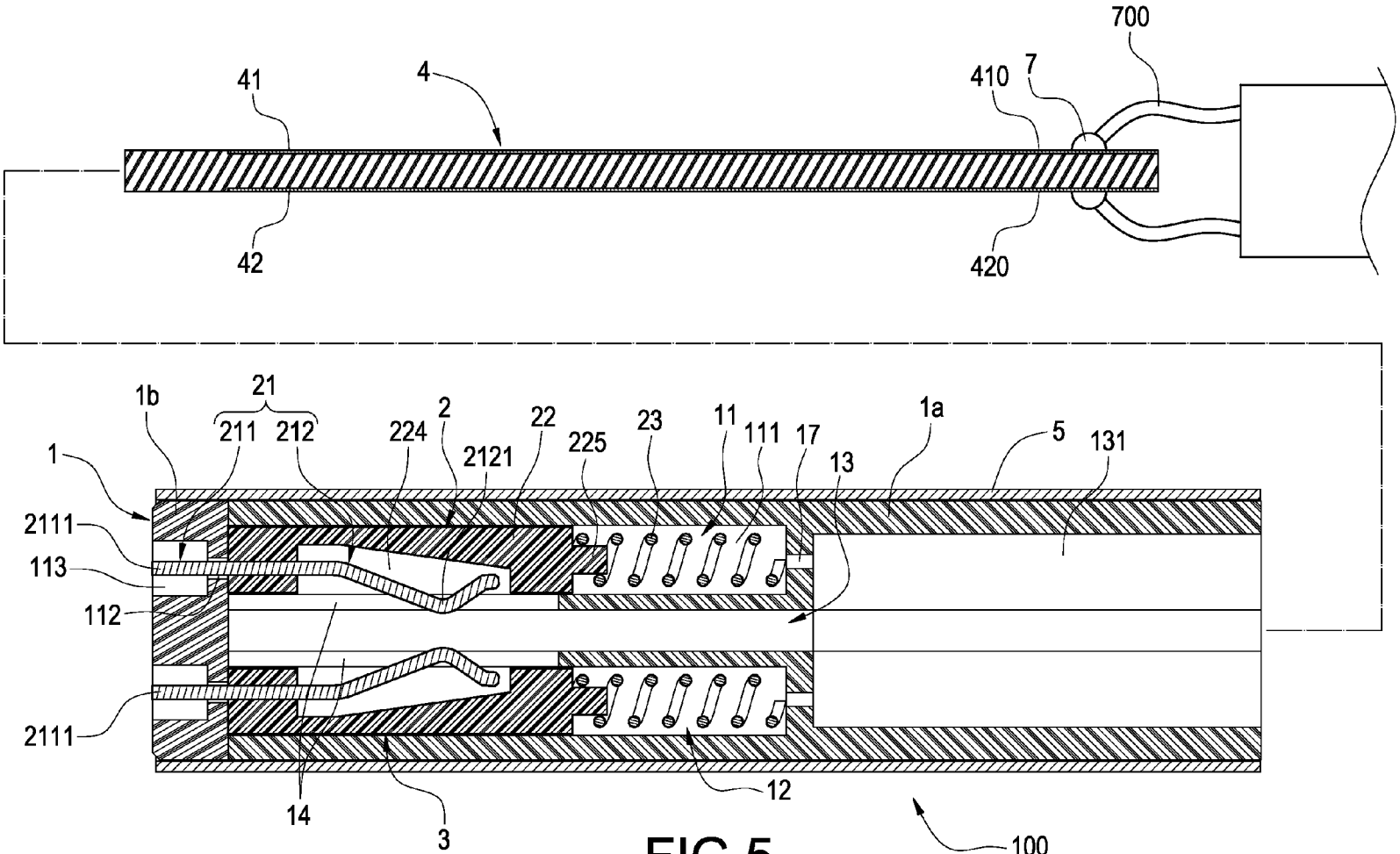
FIG. 5 is a cross-sectional view of the probe-type connector of the present invention before assembly.

As shown in FIG. 5, the above-mentioned first receiving space 11 can comprise a receiving chamber 111 and a throughhole 112 which both communicate with each other. In the current embodiment, the first receiving space 11 further comprising a connecting recess 113 is used as an example for explanation in which the throughhole 112 communicates between the connecting recess 113 and the receiving chamber 111. As shown in FIGS. 1 and 5, the first receiving spaces 11 are identical and the second receiving spaces 12 are identical. The first and second receiving spaces 11 and 12 are disposed up-down symmetrically relative to the plane of the plugging slot 13 on the first insulator 1*a*. In other words, the first insulator 1*a* is provided with the first receiving spaces 11 and the second receiving spaces 12 which are arranged in the up and down rows, respectively. The plugging slot 13 is formed and disposed longitudinally into the first insulator 1*a* from the rear end surface thereof. In particular, a cutting slot 131, narrower than the plugging slot 13, is formed on the rear end surface of the first insulator 1*a*. The cutting slot 131 overlaps and communicates with the plugging slot 13 on the rear end surface of the first insulator 1*a*. As shown in FIG. 5, a channel 14 is formed in the first receiving space 11 and the second receiving space 12 of the first insulator 1*a* corresponding to the plugging slot 13 such that the channel 14 can communicate between the first receiving space 11 and the second receiving space 12.

Figure 4:
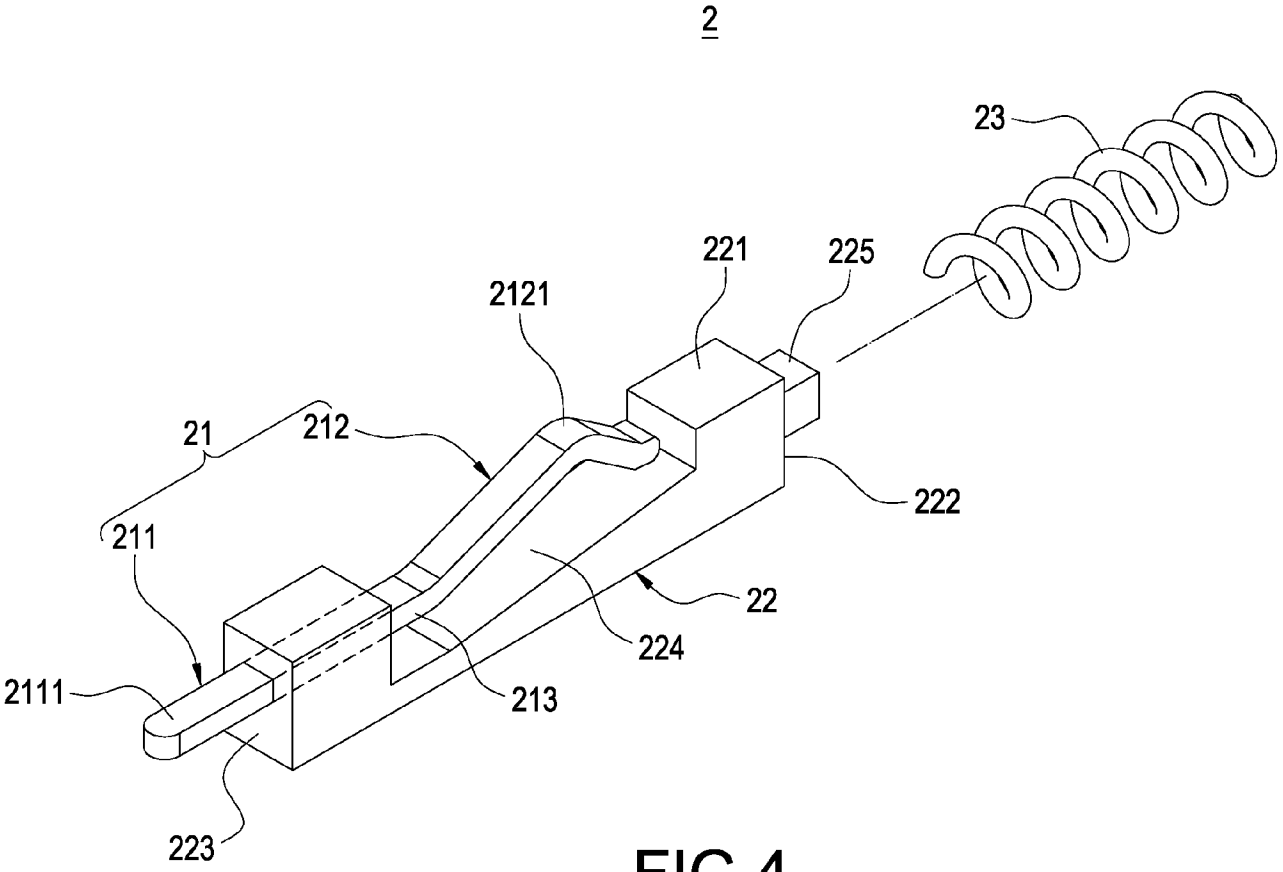
FIG. 4 is a perspective exploded view of the probe set in the present invention.

As shown in FIG. 4, the first probe set 2 comprises a probe terminal 21 (a terminal as a probe), an insulating part 22, and an elastic part 23. As shown in FIGS. 1 and 5, the first probe sets 2 are identical to the second probe sets 3. The first probe sets 2 and the identical second probe sets 3 are disposed symmetrically in the first receiving spaces 11 and the second receiving spaces 12, respectively. The probe terminal 21 has a connecting segment 211 and a flexible connecting arm 212 extending from the connecting segment 211 toward the plugging slot 13 (or the channel 14). In the current embodiment, the flexible connecting arm 212 extending as a whole from an end (a first bending portion marked with 213, referring to FIG. 4) of the connecting segment 211 will be used as an example for explanation. Besides, a first bending portion 213 can be connected between the connecting segment 211 and the flexible connecting arm 212 of the probe terminal 21; the flexible connecting arm 212 extends toward the plugging slot 13 (or the channel 14) through the first bending portion 213. The insulating part 22 is fixed to the connecting segment 211 of the probe terminal 21 and the fixed location of the insulating part 22 is near to one end (referring to Part 213) of the connecting segment 211 and far away from the other end of the connecting segment 211 opposite to the end such that the connecting segment 211 extends from the end 223 of the insulating part 22 to form an exposed portion 2111. The insulating part 22 is slidingly connected in the receiving chamber 111 and provided with a cut 224 at a side 221 thereof. The cut 224 is emptied transversely on the insulating part 22 such that the insulating part 22 almost has a "U" shape. In this way, the first probe sets 2 and the second probe sets 3 can be individually arranged side by side and the distance in between reduced. As a result, with the same amount of the probe sets, the width space occupied by the insulating body 1 can be decreased (the connector can be miniaturized). Alternatively, for the insulating body 1 having the same width, the number of the probe sets can be increased (the connector can be expanded to have other functions by increasing the number of the terminals). The cut 224 of the first probe set 2 and the cut 224 of the second probe set 3 communicate with the above-mentioned channel 14 correspondingly. The flexible connecting arm 212 of the probe terminal 21 protrudes out of the insulating part 22 through the cut 224.

According to the description above, the elastic part 23 is supported between the other end 222 of the insulating part 22 and the insulating body 1. In other words, the insulating part 22 is connected between the connecting segment 211 and the elastic part 23 such that the elastic part 23 enables the probe terminal 21 and the insulating part 22 to reciprocate in the first and second receiving spaces 11, 12 and thus the exposed portion 2111 of the probe terminal 21 protrudes through the corresponding throughhole 112 into the connecting recess 113.

As shown in FIG. 5, the connecting plate 4 is plugged and connected to the insulating body 1 corresponding to the plugging slot 13. The connecting plate 4 is provided with plural connecting portions. In the current embodiment, a PCB having plural gold fingers is used as the connecting plate 4 for explanation. The two sides of the connecting plate 4 are individually provided with plural first connecting portions 41 (gold fingers) and plural second connecting portions 42 (gold fingers), respectively. The flexible connecting arm 212 of each first probe set 2 is electrically connected to the first connecting portion 41 correspondingly. The flexible connecting arm 212 of each second probe set 3 is electrically connected to the second connecting portion 42 correspondingly. Besides, the flexible connecting arm 212 of the probe terminal 21 has a second bending portion 2121 which is used by the probe terminal 21 for the electrical connection with the first connecting portion 41 or the second connecting portion 42.

By means of the combination of the above components, the connector 100 of the present invention can be obtained. When the connecting plate 4 is pluggably plugged through the rear end surface of the insulating body 1, the flexible connecting arm 212 of each first probe set 2 will be smoothly and electrically connected to the corresponding first connecting portion 41 on a side of the connecting plate 4 and be electrically conducted. At the same time, the flexible connecting arm 212 of each second probe set 3 will be smoothly and electrically connected to the corresponding second connecting portion 42 on the other side of the connecting plate 4 and be electrically conducted.

Of course, in order to position the elastic part 23, as shown in FIGS. 1, 4, and 5, the other end 222 of the insulating part 22 has a positioning portion 225 corresponding to an end of the elastic part 23. The elastic part 23 is positioned by the positioning portion 225 to prevent falling off or shifting. Also, in order to ensure the insulating part 22 produces a smooth reciprocating movement in the receiving chamber 111 and prevent the gas from being resistance in the receiving chamber 111 due to excessive tightness, at least one vent 17 is disposed at the place where the insulating body 1 receives the elastic part 23. The vent 17 can be disposed at the end of the receiving chamber 111 corresponding to the elastic part 23 such that the gas in the receiving chamber 111 can be discharged through the vent 17 when the insulating part 22 slides (i.e., the elastic part 23 is subjected to a force) in the receiving chamber 111. Consequently, the insulating part 22 can perform the reciprocating movement with high smoothness.

In addition, as shown in FIGS. 1, 2, 3, and 5, the connector 100 of the present invention can be covered with a metal shell 5. The metal shell 5 covers the insulating body 1 and exposes the each connecting recess 113 on the front end surface and the plugging slot 13 on the rear end surface of the insulating body 1.

As shown in FIG. 5, the connector 100 of the present invention can be applied to a PCB (now shown) or a cable 700. In the current embodiment, the connecting plate 4 applied to the cable 700 is used as an example for explanation. The first connecting portions 41 and the second connecting portions 42 of the connecting plate 4 are individually extended to form the first welding portions 410 and the second welding portions 420 on the rear end of the connecting plate 4. The first welding portions 410 and the second welding portions 420 are individually welding to the wire cores 7 of the cables 700 such that the connector 100 of the present invention is electrically connected to the cables 700. Also, the cables 700 are welded to the first and second connecting portions 41, 42 via the wire cores 7 and penetrate into the plugging slot 13 on the rear end surface of the insulating body 1, which reduces the explosion area of the welding portions.

Figure 6:
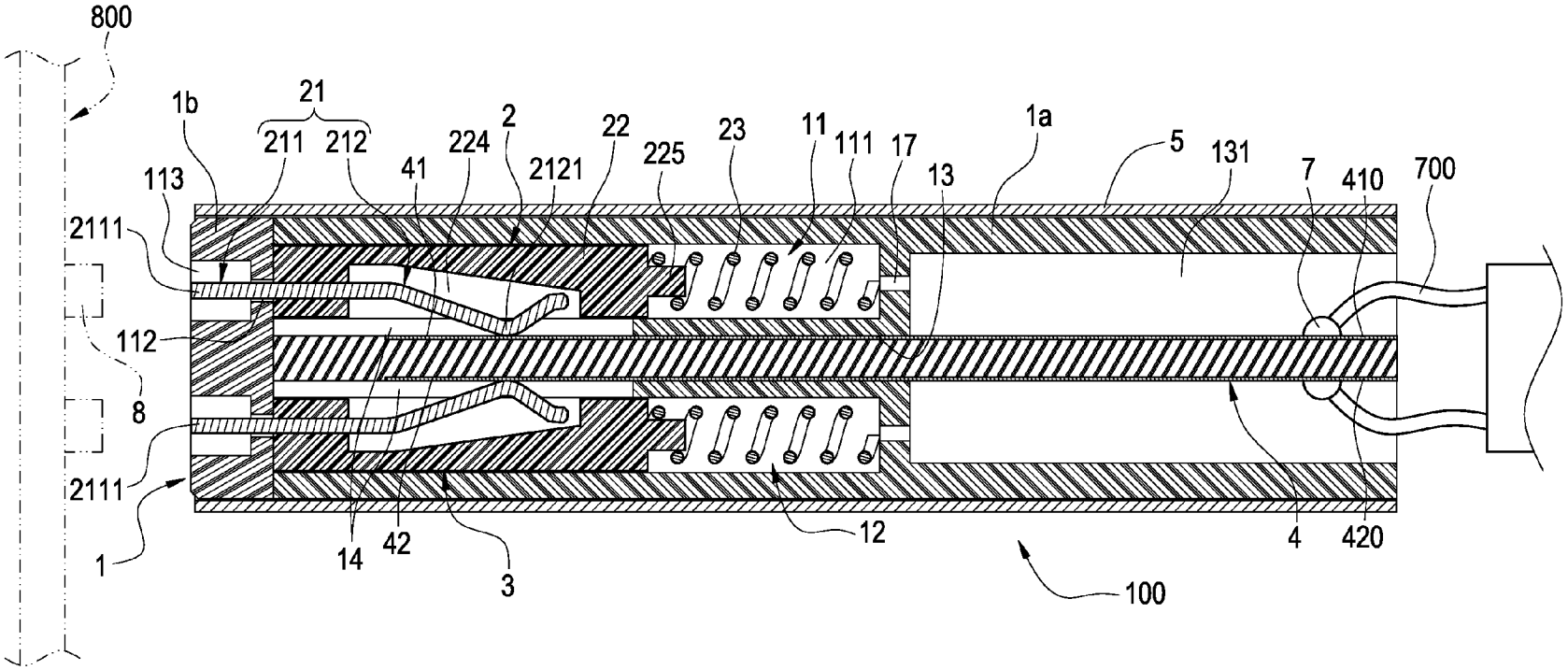
FIG. 6 is a cross-sectional view of the probe-type connector of the present invention in operation (before plugging)
Figure 7:
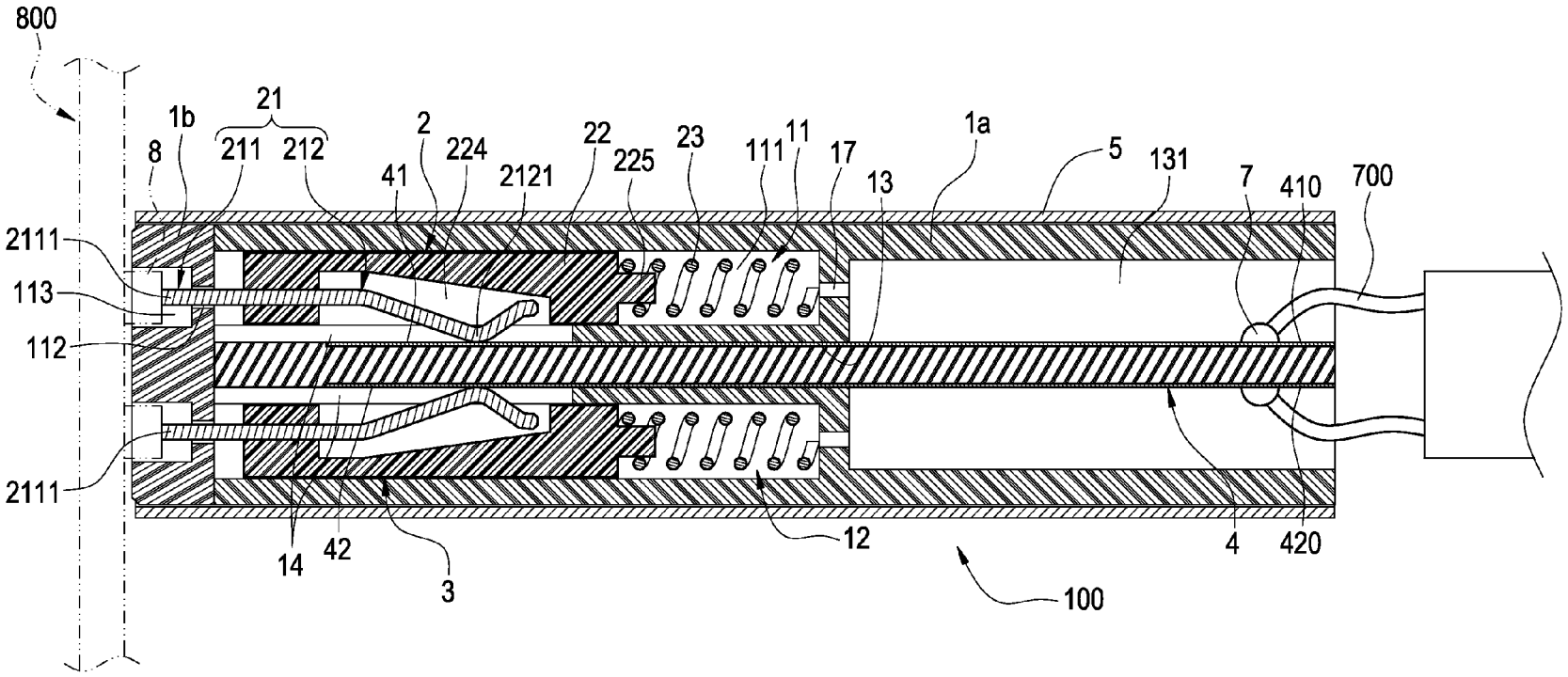
FIG. 7 is a cross-sectional of the probe-type connector of the present invention in operation (after plugging).

As shown in FIGS. 6 and 7, when a user installs a connected product 800 into the installation space of the electronic device, the connecting parts 8 of the connected product 800 are individually plugged into the corresponding connecting recesses 113 of the connector 100 of the present invention such that each connecting part 8 is pressed against the exposed portion 2111 of the connecting segment 211 of the corresponding probe terminal 21 which smoothly retracts to compress the corresponding elastic part 23. At this time, each probe terminal 21 uses the flexible connecting arm 212 thereof to maintain the electrical connection with the first and second connecting portions 41, 42 of the connecting plate 4. In this way, the electrical energy or signals of the connected product 800 can be transmitted to the cables 700 through the probe terminals 21 and the first and second connecting portions 41, 42 of the connecting plate 4.

Figure 2:
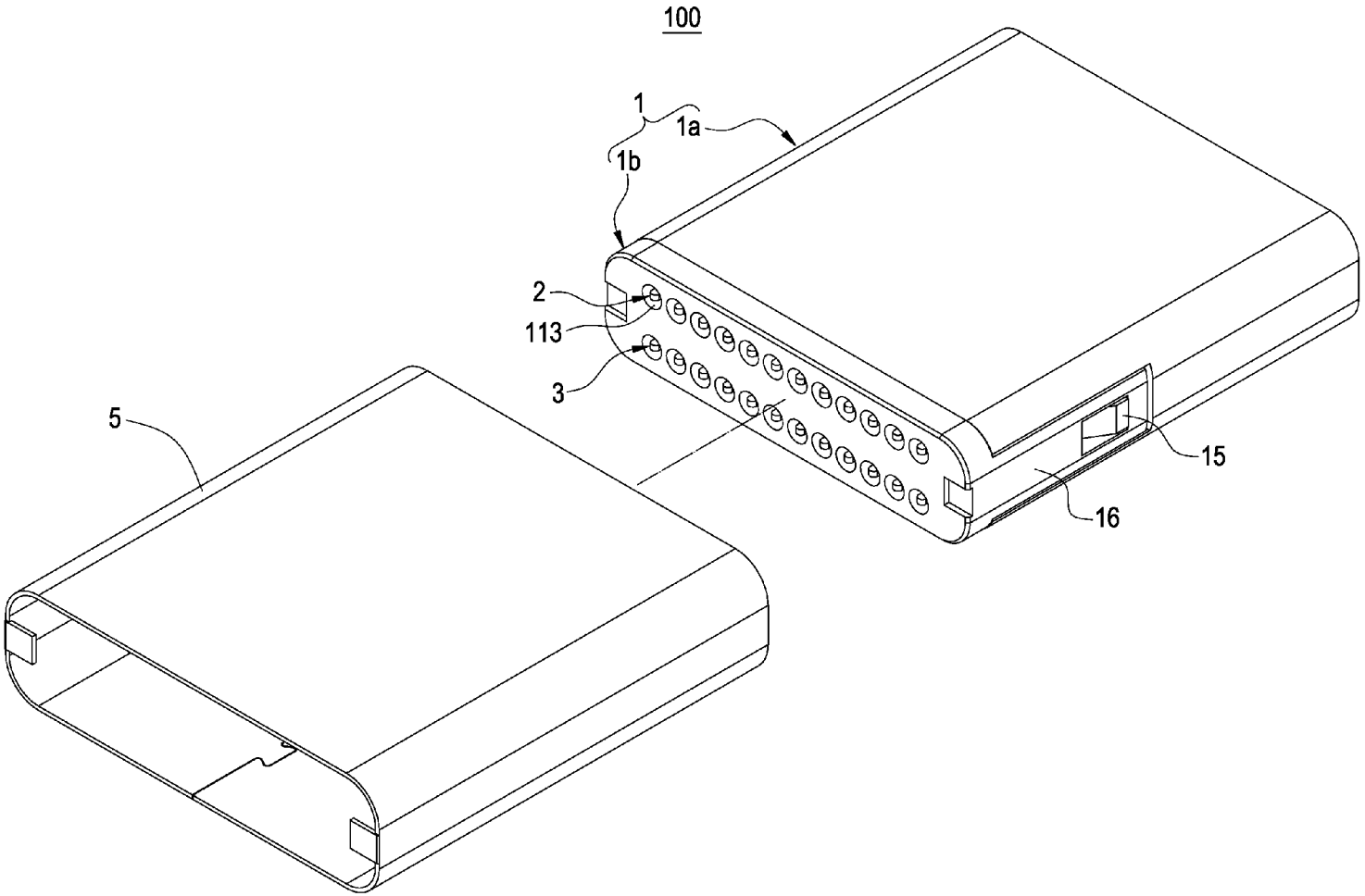
FIG. 2 is a perspective exploded view of the probe-type connector of the present invention according to FIG. 1 after assembly and assembled with the metal shell.
Figure 3:
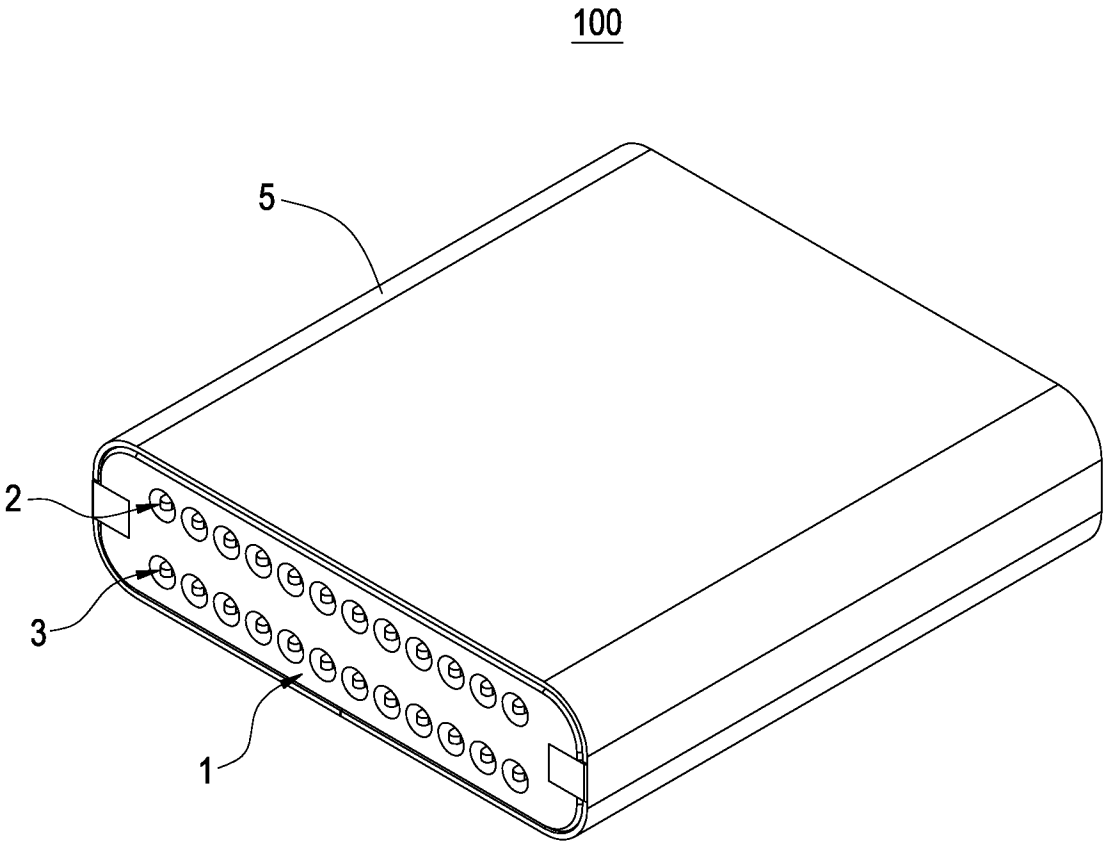
FIG. 3 is a perspective assembled view of the probe-type connector of the present invention.

As for the combination method of the insulating body 1, as shown in FIGS. 1 and 2, two latch tabs 15 are individually disposed on left and right sides of the first insulator 1*a*. The second insulator 1*b* is provided with the latch arms 16 corresponding to the latch tabs 15 such that the first and second insulators 1*a*, 1*b* combine to form the insulating body 1.

In summary, compared with the prior art, the present invention has the follow effects. By means of the flexible connecting arm 212 extending from the probe terminal 21, the electrical signals can be transmitted directly to the connecting plate 4, which prevents the excessive connecting components on the transmission path and the signal attenuation caused by undue transmission path. Thus, the present invention can be applied to the transmission of high-frequency signals or high-frequency electric energy and can obtain a good transmission effect. Besides, the first and second probe sets 2, 3, the first and second receiving spaces 11, 12, the plugging slot 13, and the connecting plate 4 can be plugged and connected to the connecting plate 4 corresponding only to the positon of the plugging slot 13, which allows plenty of first and second probe sets 2, 3 to be individually electrically connected to the first and second connecting portions 41, 42 of the connecting plate 4, respectively. Thus, the problem of installing the connecting terminals one by one into the existing connector can be solved and then has the effect of easy assembly.

Moreover, the present invention also has other effects. The insulation of the insulating part 22 between the probe terminal 21 and the elastic part 23 prevents the electrical energy or signals from transmitting to the elastic part 23. In this way, the elastic part 23 of a spiral spring type will not produce an inductive effect and relevant interference. Further, when the first and second probe sets 2, 3 slide, the insulating material of the insulating parts 22 is used to contact the insulating body 1 having the similar insulating material to produce friction, which significantly reduces the wear of insulating material and ensures the sliding stability of the probe terminals 21. Additionally, the cut 224 is emptied transversely on the insulating part 22, which can reduce the spacing. Besides, a vent 17 is disposed at the place when the insulating body 1 receives the elastic part 23, which allows the insulating part 22 to perform a reciprocating sliding movement with high smoothness.

The embodiments described above are only preferred ones of the present invention and not to limit the claimed scope of the present invention. Therefore, all the equivalent structure modifications and variations applying the specification and figures of the present invention should be embraced by the claimed scope of the present invention.

What is claimed is:

1. A probe-type connector, comprising:

an insulating body provided with a receiving space and a plugging slot which both communicate with each other;

a probe set received in the receiving space and comprising a probe terminal, an insulating part, and an elastic part, wherein the probe terminal has a connecting segment and a flexible connecting arm extending from the connecting segment toward the plugging slot, wherein the insulating part is connected between the connecting segment and the elastic part, wherein the elastic part enables the insulating part and the probe terminal to reciprocate in the receiving space; and a connecting plate provided with a connecting portion, wherein the connecting plate is plugged and connected to the insulating body corresponding to the plugging slot, wherein the flexible connecting arm of the probe terminal is electrically connected to the connecting portion.

2. The probe-type connector according to claim 1, wherein the connecting plate is a PCB, wherein the connecting portion is a gold finger disposed on the PCB.

3. The probe-type connector according to claim 1, wherein the flexible connecting arm of the probe terminal extends from an end of the connecting segment, wherein the insulating part is fixed to the connecting segment.

4. The probe-type connector according to claim 3, wherein the receiving space comprises a receiving chamber and a through hole which both communicate with each other, wherein the insulating part is slidingly connected in the receiving chamber and provided with a cut, wherein the flexible connecting arm of the probe terminal is electrically connected to the connecting portion via the cut, wherein the connecting segment has the other end opposite to the end, wherein the other end of the connecting segment protrudes corresponding to the through hole.

5. The probe-type connector according to claim 4, wherein the cut is emptied transversely on the insulating part.

6. The probe-type connector according to claim 1, wherein a first bending portion is connected between the connecting segment and the flexible connecting arm of the probe terminal, wherein the flexible connecting arm extends toward the plugging slot through the first bending portion.

7. The probe-type connector according to claim 1, wherein flexible connecting arm of the probe terminal has a second bending portion, wherein the probe terminal is electrically connected to the connecting portion via the second bending portion.

8. The probe-type connector according to claim 1, wherein the insulating body is provided with at least one vent where the elastic part is located.

9. The probe-type connector according to claim 1, further comprising another probe set, wherein the insulating body is provided with another receiving space, wherein the probe set and the another probe set are symmetrically disposed in the receiving space and the another receiving space, respectively, wherein two sides of the connecting plate are individually provided with the connecting portion and another connecting portion, wherein the flexible connecting arm of the probe set and the flexible connecting arm of the another probe set are individually electrically connected to the connecting portion and the another connecting portion of the connecting plate, respectively.

10. The probe-type connector according to claim 1, wherein the connecting plate is pluggably plugged into the insulating body corresponding to the plugging slot.

* * * * *